US008614389B2

(12) United States Patent
Wallace et al.

(10) Patent No.: US 8,614,389 B2
(45) Date of Patent: Dec. 24, 2013

(54) MUSICAL INSTRUMENT WITH ONE SIDED THIN FILM CAPACITIVE TOUCH SENSORS

(71) Applicant: Pure Imagination LLC, Vancouver, WA (US)

(72) Inventors: Michael Wallace, Vancouver, WA (US); Philp Trevor Odom, Vancouver, WA (US)

(73) Assignee: Pure Imagination, LLC, Vancouver, WA (US)

( * ) Notice: Subject to any disclaimer, the term of this patent is extended or adjusted under 35 U.S.C. 154(b) by 0 days.

(21) Appl. No.: 13/673,880

(22) Filed: Nov. 9, 2012

(65) Prior Publication Data

US 2013/0068087 A1 Mar. 21, 2013

Related U.S. Application Data

(62) Division of application No. 13/163,401, filed on Jun. 17, 2011, now Pat. No. 8,471,138.

(60) Provisional application No. 61/355,564, filed on Jun. 17, 2010.

(51) Int. Cl.
*G10H 3/10* (2006.01)

(52) U.S. Cl.
USPC ..... 84/733

(58) Field of Classification Search
USPC ..... 84/733
See application file for complete search history.

(56) References Cited

U.S. PATENT DOCUMENTS

| | | | | |
|---|---|---|---|---|
| 4,176,575 | A | 12/1979 | Munch | |
| 4,336,734 | A | 6/1982 | Polson | |
| 5,283,711 | A * | 2/1994 | Schmitz | 361/286 |
| 6,822,640 | B2 | 11/2004 | Derocher | |
| 2001/0033009 | A1 | 10/2001 | Inoue et al. | |
| 2009/0315258 | A1 * | 12/2009 | Wallace et al. | 273/238 |
| 2010/0283755 | A1 | 11/2010 | Hsih | |
| 2011/0050620 | A1 * | 3/2011 | Hristov | 345/174 |
| 2011/0109590 | A1 | 5/2011 | Park | |

OTHER PUBLICATIONS

Elvin Enad, International Preliminary Report on Patentability (corrected), PCT/US11/40913, Oct. 20, 2012, pp. 1-26, IPEA/USPTO, Alexandria VA, USA.

Elvin Enad, International Preliminary Report on Patentability, PCT/US11/45598, Jan. 16, 2013 pp. 1-28, IPEA/USPTO, Alexandria VA, USA.

Kenneth Bukowski, Office Action, U.S. Appl. No. 12/843,201, Jan. 18, 2013, pp. 1-32, USPTO, Alexandria VA, USA.

Gary F Pauman, Office Action, U.S. Appl. No. 13/668,128, Feb. 21, 2013, pp. 1-6, USPTO, Alexandria VA, USA.

* cited by examiner

*Primary Examiner* — Jianchun Qin

(74) *Attorney, Agent, or Firm* — Rylander & Associates, PC; Philip R. M. Hunt

(57) ABSTRACT

Touch sensitive musical instruments are described herein including embodiments having: one-sided capacitive touch sensors with conductive ground planes, one-sided capacitive touch sensors with air gaps, one-sided capacitive touch sensors with separating material, and/or one-sided capacitive touch sensors including a combination of conductive ground planes, air gaps, and/or separating material. Embodiments of touch sensitive musical instruments simulating string instruments such as guitars are described.

10 Claims, 14 Drawing Sheets

MUSICAL INSTRUMENT WITH ONE SIDED THIN FILM CAPACITIVE TOUCH SENSORS

CROSS-REFERENCE TO RELATED APPLICATION

The present application is a divisional of and claims priority to U.S. Nonprovisional application Ser. No. 13/163,401 filed on Jun. 17, 2011, which in turn claims the benefit of, and priority to, U.S. Provisional Application No. 61/335,564 filed on Jun. 17, 2010, all of which are incorporated herein by reference.

FIELD OF THE INVENTION

The present invention relates to the field of musical instruments. In particular, the present invention relates to musical instruments that generate sound electronically.

BACKGROUND

A recent proliferation of inexpensive computer processors and logic devices has influenced games, toys, books, and the like. Some kinds of games, toys, and books use embedded sensors in conjunction with control logic coupled to audio and/or visual input/output logic to enrich the interactive experience provided by the game, toy, book, or the like. An example is a book or card (e.g., greeting card) that can sense the identity of an open page or card and provide auditory feedback to the reader relevant to the content of the open page or card.

One type of sensor used in games, toys and books is a capacitive touch sensor. A capacitive touch sensor typically is a small capacitor enclosed in an electrical insulator. The capacitor has an ability to store an electrical charge, referred to as capacitance. When a power source applies an increased voltage across the capacitor, electrical charges flow into the capacitor until the capacitor is charged to the increased voltage. Similarly, when the power source applies a decreased voltage the capacitor, electrical charges flow out of the capacitor until the capacitor is discharged to the decreased voltage. The amount of time it takes for the capacitor to charge or discharge is dependent on the change in voltage applied and the capacitance of the capacitor. If the capacitance is unknown, it can calculated from the charge or discharge time and the change in voltage applied. A person touching or coming close to a capacitive touch sensor can change the sensor's effective capacitance by combining the person's capacitance with the capacitance of the capacitive touch sensor. This change in effective capacitance can be detected by a change in the charge or discharge times.

Most common capacitive touch sensors, such as those used in cell phones and ATMs are made on inflexible substrates several millimeters thick and protected by glass. Thin film capacitive touch sensors are known, such as those taught in U.S. Pat. No. 6,819,316 "Flexible capacitive touch sensor." However, thin film capacitive touch sensors are not used much. One reason is that thin film capacitive touch sensors can exhibit a "two-sided" effect that makes thin film capacitive touch sensors sensitive to touch on both sides of the sensor.

A number of prior art patents have described games (e.g., board games), toys, books, and cards that utilize computers and sensors to detect human interaction with elements of the board games, toys, books, and cards. The following represents a list of known related art:

| Reference: | Issued to: | Date of Issue/Publication: |
|---|---|---|
| U.S. Pat. No. 5,645,432 | Jessop | Jul. 8, 1997 |
| U.S. Pat. No. 5,538,430 | Smith et al. | Jul. 23, 1996 |
| U.S. Pat. No. 4,299,041 | Wilson | Nov. 10, 1981 |
| U.S. Pat. No. 6,955,603 | Jeffway, Jr. et al | Oct. 18, 2005 |
| U.S. Pat. No. 6,168,158 | Bulsink | Jan. 2, 2001 |
| U.S. Pat. No. 5,853,327 | Gilboa | Dec. 29, 1998 |
| U.S. Pat. No. 5,413,518 | Lin | May 9, 1995 |
| U.S. Pat. No. 5,188,368 | Ryan | Feb. 23, 1993 |
| U.S. Pat. No. 5,129,654 | Bogner | Jul. 14, 1992 |

The teachings of each of the above-listed citations (which does not itself incorporate essential material by reference) are herein incorporated by reference. None of the above inventions and patents, taken either singularly or in combination, is seen to describe an embodiment or embodiments of the instant invention described below and claimed herein.

For example, U.S. Pat. No. 5,853,327 "Computerized Game Board" describes a system that automatically senses the position of toy figures relative to a game board and thereby supplies input to a computerized game system. The system requires that each game piece to be sensed incorporate a transponder, which receives an excitatory electromagnetic signal from a signal generator and produces a response signal that is detected by one or more sensors embedded in the game board. The complexity and cost of such a system make it impractical for low-cost games and toys.

U.S. Pat. No. 5,129,654 "Electronic Game Apparatus," U.S. Pat. No. 5,188,368 "Electronic Game Apparatus," and U.S. Pat. No. 6,168,158 "Device for Detecting Playing Pieces on a Board" all describe systems using resonance frequency sensing to determine the position and/or identity of a game piece. Each system requires a resonator circuit coupled with some particular feature of each unique game piece, which increases the complexity and cost of the system while reducing the flexibility of use.

U.S. Pat. No. 5,413,518 "Proximity Responsive Toy" describes another example of a toy incorporating automatic sensing that utilizes a capacitive touch sensor coupled to a high frequency oscillator, whereby the frequency of the oscillator is determined in part by the proximity of any conductive object (such as a human hand) to the capacitive touch sensor. This system has the disadvantages of requiring specialized electronic circuitry that may limit the number of sensors that can be simultaneously deployed.

U.S. Pat. No. 6,955,603 "Interactive Gaming Device Capable of Perceiving User Movement" describes another approach to sensing player interaction by using a series of light emitters and light detectors to measure the intensity of light reflected from a player's hand or other body part. Such a system requires numerous expensive light emitters and light detectors, in particular for increasing the spatial sensitivity for detection.

U.S. Pat. No. 5,645,432 "Toy or Educational Device" describes a toy or educational device that includes front and back covers, a spine, a plurality of pages, a plurality of pressure sensors mounted in the front and back covers and a sound generator connected to the pressure sensors. The pressure sensors are responsive to the application of pressure to an aligned location of a page overlying the corresponding cover for actuating the sound generator to generate sounds associated with both the location of the sensor which is depressed and the page to which pressure is applied.

U.S. Pat. No. 5,538,430 "Self-reading Child's Book" describes a self-reading electronic child's book that displays a sequence of indicia, such as words, and has under each indicia a visual indicator such as a light-emitting diode with the visual indicators being automatically illuminated in sequence as the child touches a switch associated with each light-emitting diode to sequentially drive a voice synthesizer that audibilizes the indicia or word associated with the light and switch that was activated.

U.S. Pat. No. 4,299,041 "Animated Device" describes a device in the form of a greeting card, display card, or the like, for producing a visual and/or a sound effect that includes a panel member or the like onto which is applied pictorial and/or printed matter in association with an effects generator, an electronic circuit mounted on the panel member but not visible to the reader of the matter but to which the effects generator is connected, and an activator on the panel member, which, when actuated, causes triggering of the electronic circuit to energize the effects generator.

Each of the prior art patents included above describes a game, toy, book, and/or card that requires expensive components or manufacturing techniques and/or exhibits limited functionality. As will be described below, embodiments of the present invention overcome these limitations.

SUMMARY AND ADVANTAGES

Embodiments of a musical instrument resembling a guitar with touch sensitive sensors are described herein. Some embodiments comprise a capacitive touch sensor layer, a separation layer adjacent the capacitive touch sensor layer, and a conductive ground plane layer adjacent the separation layer to shield a backside of the capacitive touch sensor layer. Other embodiments have touch sensitive sensors comprising a capacitive touch sensor layer and separation layer to create an air gap layer adjacent the capacitive touch sensor layer to shield a backside of the capacitive touch sensor layer.

The system and method for thin capacitive touch sensors of the present invention present numerous advantages, including: (1) inexpensive and simple construction; (2) substantially one-sided triggering of the capacitive touch sensors in particular for hand-held devices; (3) thin construction; (4) touch sensing application to games, board games, toys, books, and greeting cards; and (5) integration of printed art on a layer or substrate with the capacitive touch sensors.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
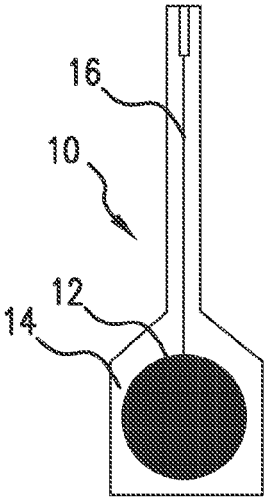
FIGS. 1-4 illustrate several embodiments of thin film capacitive touch sensors with different fill patterns.

In the drawings, similar reference characters denote similar elements throughout the several figures. With regard to the reference numerals used, the following numbering is used throughout the various drawing figures:

10 thin film capacitive touch sensor
12 capacitive element
14 thin film substrate
16 interconnect
20 50% fill pattern capacitive touch sensor
22 50% fill pattern capacitive element
30 35% fill pattern capacitive touch sensor
32 35% fill pattern capacitive element
34 thin film capacitive touch sensor
36 capacitive field
42 printed art layer
44 capacitive touch sensor layer
46 capacitive elements
48 thin film substrate
52 printed art layer
54 capacitive touch sensor layer
56 capacitive elements
58 thin film substrate
60 one-sided thin film capacitive touch sensor
62 conductive ground plane layer
64 capacitive touch sensor layer
66 separation layer
70 one-sided thin film capacitive touch sensor
71 capacitive elements
72 conductive ground plane layer
74 capacitive touch sensor layer

76 separation layer
78 thin film
80 electronics
170 one-sided thin film capacitive touch sensor
172 capacitive touch sensor layer
174 separating base
176 air gap layer
180 one-sided thin film capacitive touch sensor
182 capacitive touch sensor layer
184 separating base
186 air gap layer
190 one-sided thin film capacitive touch sensor
192 capacitive touch sensor layer
194 thick separating material
200 one-sided thin film capacitive touch sensor
202 capacitive touch sensor layer
204 corrugated structure
206 air gap layer
220 capacitive guitar
222 guitar body
224 neck conductive ground plane layer
226 neck housing
228 guitar neck
230 body conductive ground plane layer
232 body separation layer
234 printed art layer
236 capacitive touch sensor layer
238 electronics package
239 speaker
340 capacitive guitar
342 guitar body
344 air gap layer
346 neck housing
348 guitar neck
350 conductive ground plane layer
352 body separation layer
354 printed art layer
356 capacitive touch sensor layer
358 electronics package
359 speaker
372 printed art layer
374 capacitive touch sensor layer
376 strum sensors
378 fret sensors
380 guitar neck
382 high neck sensor
384 palm mute sensor
386 control sensors
388 PCB bus connection
390 conductive traces
392 upper strum sensor
394 lower strum sensor
396 up strum signal trace
398 down strum signal trace
400 common cord sample
402 up strum attack sample
404 down strum attack sample

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIGS. 1-24 illustrate embodiments of an electronic musical instrument using capacitive touch sensors. The electronic musical instrument described in these embodiments is a guitar, but those of skill in the art will realize that the teachings describe herein are applicable to other electronic musical instruments simulating stringed musical instruments, such as banjos, violins, cellos, etc.

Capacitive Touch Sensor Design (FIGS. 1-13)

Figure 7:
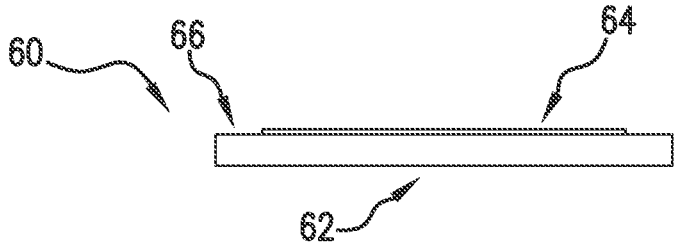
FIG. 7 illustrates a one-sided thin film capacitive touch sensor with a conductive ground plane layer.
Figure 8:
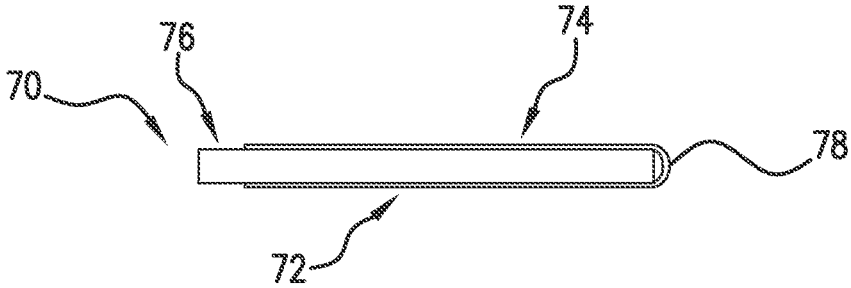
FIG. 8 illustrates a one-sided thin film capacitive touch sensor with an alternative ground plane configuration.
Figure 9:
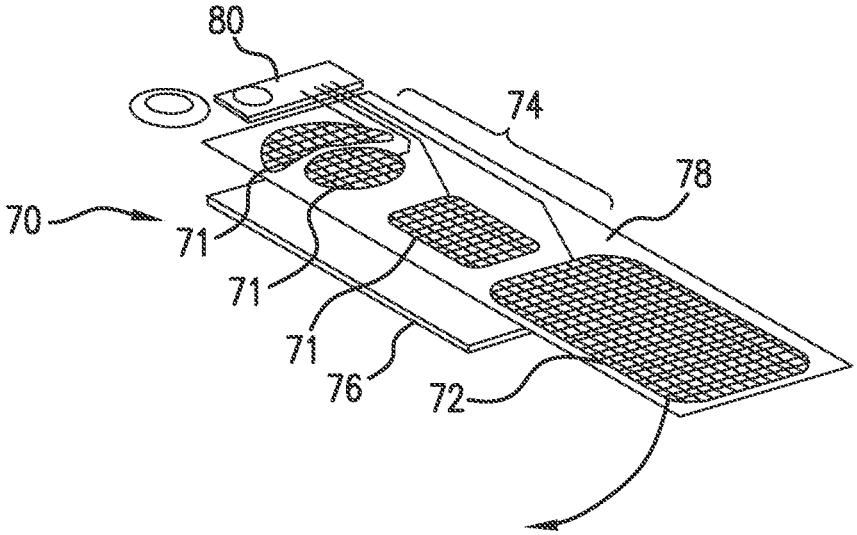
FIG. 9 shows another view of the one-sided thin film capacitive touch sensor of FIG. 8.

FIGS. 1-6 generally describe the construction of two-sided thin film capacitive touch sensors. FIGS. 7-9 generally describe one-sided thin film capacitive touch sensors with conductive ground plane layers. FIGS. 10-13 generally describe one-sided thin film capacitive touch sensors with air gap layers or separation layers. The relative low cost and simplicity/elegance of these thin film capacitive touch sensors enable games (e.g., board games), toys (e.g., musical instruments such as guitars and drums), books, and greeting cards to include touch sensitive functionality.

Many existing capacitive touch sensor design kits available from manufacturers use printed circuit boards to create and connect thin film capacitive touch sensors. This approach is too expensive and cumbersome for most low-cost applications (e.g., game, toy, book, etc.). A low-cost alternative is to manufacture thin film capacitive touch sensors (thin compared to printed circuit boards). One method of manufacturing thin film capacitive touch sensors is to print the elements of the capacitors with conductive ink onto a thin film substrate using a screen printing technique. The thin film substrate may be a sheet of material like plastic (e.g., polyester) or paper. In addition to being lower cost than a printed circuit board, thin film substrates such as polyester or paper are more flexible.

FIGS. 1-4 illustrate several embodiments of thin film capacitive touch sensors with different fill patterns. FIG. 1 shows a thin film capacitive touch sensor 10 with a solid fill pattern. The thin film capacitive touch sensor 10 has a thin film substrate 14 and a capacitive element 12. The capacitive element 12 is made of conductive ink deposited without porosity on the thin film substrate 14, giving it a solid fill pattern. In this embodiment, the conductive ink is deposited using a screen printing technique, but in other embodiments, other techniques may be used. The thin film capacitive touch sensor 10 also has an interconnect 16, configured to electrically connect the capacitive element 12 to circuits outside of the thin film capacitive touch sensor 10. In this embodiment, the interconnect 16 is also conductive ink deposed on the thin film substrate 14. Capacitive elements and interconnects are collectively referred to herein as "conductive pathways."

The conductive ink used generally includes a polymer and a metal and/or carbon conductive material. For example, the polymer may include powdered and/or flaked silver, gold, copper, nickel, and/or aluminum. In some embodiments, the conductive pathways range from less than 100 Ohms to 8K Ohms resistance, depending on their material composition and configuration. Conductive ink with less conductive material may be less expensive, but may exhibit greater resistivity. Conductive ink with a greater amount of conductive material may be more expensive, but may exhibit decreased resistivity.

Alternately, instead of screen printed conductive ink, one or more of the conductive pathways may be formed from thin copper or other metal layers. For example, one or more of the conductive pathways may be formed from a thin copper sheet that is photo-lithographically patterned and etched to form one or more of the conductive pathways, i.e. the capacitive element and/or related interconnects. Capacitive elements with partial fill patterns may be etched from thin metal as well. The copper conductive pathways may be laminated to a flexible substrate layer. Accordingly, both the copper and conductive ink conductive pathway embodiments, or a combination thereof, may form at least part of a flexible circuit (e.g., a "flex" circuit).

The cost of capacitive touch sensors may be mitigated by substituting the capacitive element 12 with the solid fill pattern shown in FIG. 1 with a capacitive element having a partial fill pattern, resulting in a partial fill pattern capacitive touch sensor. The partial fill pattern capacitive element is porous. Stated differently, an area of the thin film substrate under the partial fill pattern capacitive element has less than complete conductive ink coverage. However, the partial fill pattern capacitive element is continuous, so that electrical charges can flow to all parts of the element.

Figure 2:
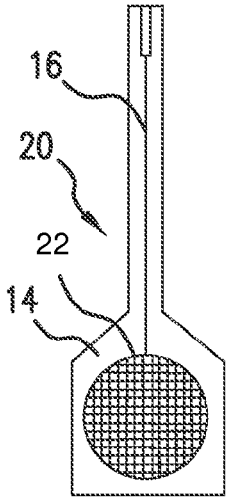
Figure 3:
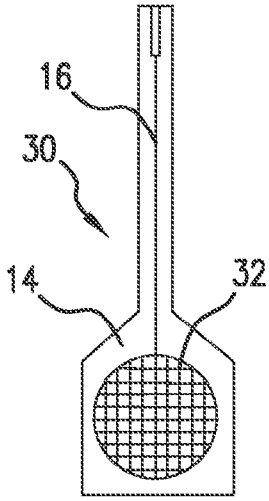

As examples of partial fill pattern capacitive touch sensors, FIG. 2 shows a 50% fill pattern capacitive touch sensor 20 and FIG. 3 shows a 35% fill pattern capacitive touch sensor 30. In FIG. 2, the 50% fill pattern capacitive touch sensor 20 has a 50% fill pattern capacitive element 22, meaning only 50% of a thin film substrate 14 under the 50% fill pattern capacitive element 22 is covered by conductive material. In FIG. 3, the 35% fill pattern capacitive touch sensor 30 has a 35% fill pattern capacitive element 32, meaning only 35% of a thin film substrate 14 under the 35% fill pattern capacitive element 32 is covered by conductive material. As the percentage of fill pattern decreases, the capacitance of the capacitive touch sensor is reduced, but the area covered by the capacitive touch sensor remains the same. For many applications that detect human finger touches, reducing the fill pattern down to as little as 35% may decrease the cost of the capacitive touch sensor substantially without suffering significant performance loss. Thus a capacitive element can remain a large target for a user to touch, but with reduced conductive material.

In the embodiments shown in FIGS. 1-3, the partial fill pattern shown is a rectilinear grid of crisscrossed horizontal and vertical lines intersecting at right angles. However, other partial fill patterns may be used, such as a regular pattern of small circular pores. For convenience, herein "grid" shall mean any partial fill pattern.

Figure 4:
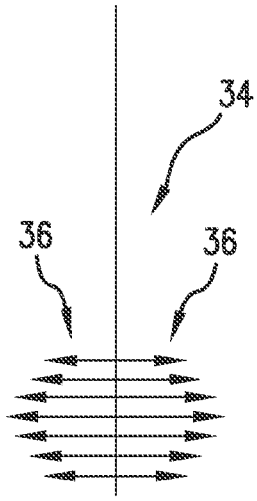

FIG. 4 shows a side view of a thin film capacitive touch sensor 34 like those discussed regarding FIGS. 1-3. When charged, a capacitive field 36 extends from the front and back of the thin film capacitive touch sensor 34. The capacitive field 36 is an electrical field that will interact with nearby conductive objects, such as a human finger, changing the effective capacitance of the thin film capacitive touch sensor 34. The thin film capacitive touch sensor 34 can be said to be "two-sided," since interaction with the capacitive field 36 on either the front side or back side can be detected via the change in effective capacitance.

In some embodiments, any additional electronics that couple to the one or more capacitive elements and related interconnects may be at least in part be included on the same flexible substrate as the one or more thin film capacitive touch sensors. Alternately, at least some of the additional electronics may be included on a separate substrate. For example, at least some of the electronics may be included on a separate printed circuit board. Multiple circuits on multiple substrates may be electrically coupled together with any electrical coupling devices and/or methods known in the art.

Figure 5:
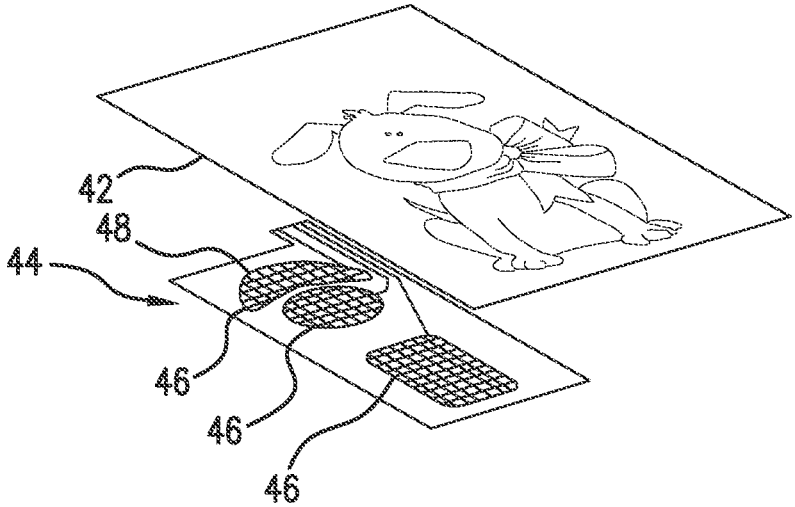
FIGS. 5 and 6 illustrate methods of combining thin film capacitive touch sensors with printed art.
Figure 6:
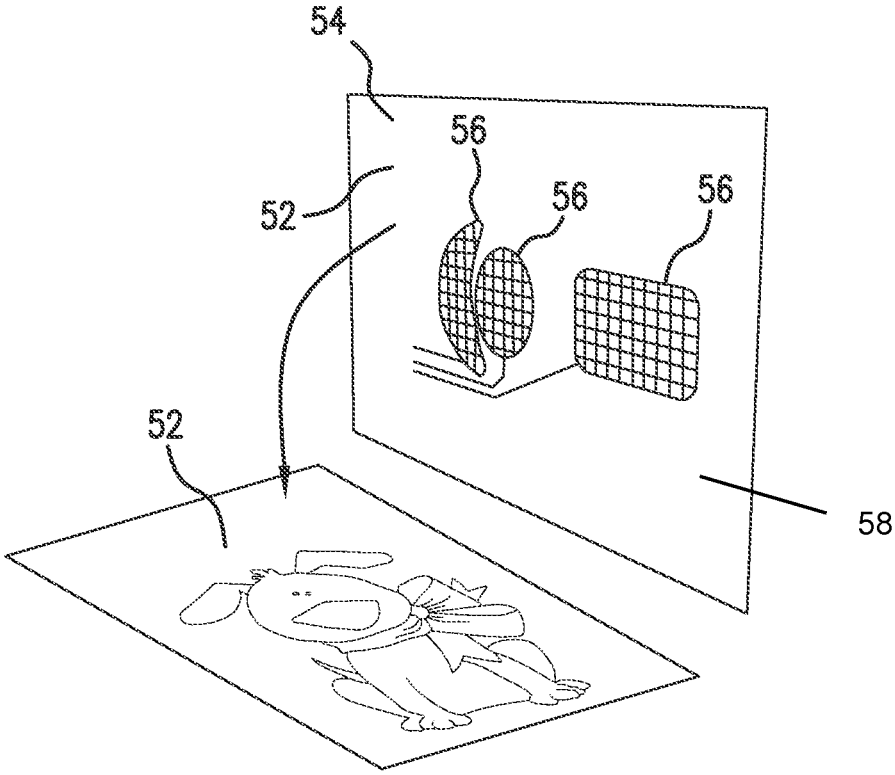

FIGS. 5 and 6 illustrate methods of combining thin film capacitive touch sensors with printed art. FIG. 5 illustrates a first method of combining thin film capacitive touch sensors with printed art. A capacitive touch sensor layer 44 is coupled to a printed art layer 42 by lamination, gluing or other process. This capacitive touch sensor layer 44 comprises one or more (three in the embodiment shown) capacitive elements 46 deposed on a thin film substrate 48 (e.g. paper or plastic), forming one or more thin film capacitive touch sensors, similar in construction to those described in the discussion regarding FIGS. 1-4. In this embodiment, the capacitive elements 46 are conductive ink deposed on the thin film substrate 48 using a screen printing process. In other embodiments, the capacitive elements 46 may be made with lithography out of metal foil, or some other method.

FIG. 6 illustrates a second method of combining thin film capacitive touch sensors with printed art. Here, a printed art layer 52 comprises art printed directly onto a thin film substrate 58. One or more capacitive elements 56 are deposed onto the same thin film substrate 58 as well, forming a capacitive touch sensor layer 54. Thus in this embodiment, the capacitive touch elements are part of the printed art layer 52. Stated differently, the capacitive touch sensor layer 54 is integrated with the printed art layer 52. In some embodiments, an opaque layer of non-conductive ink may be printed on the printed art layer 52 over the art and the capacitive elements 56 printed over the opaque layer. This opaque layer substantially prevents the conductive pathways and/or product supporting structure from showing through the thin film substrate 58. In other embodiments, the capacitive elements 56 are printed directly over the printed art layer 52 without an opaque layer.

One-Sided Capacitive Touch Sensors with a Ground Plane (FIGS. 7-9)

FIGS. 7-9 illustrate embodiments of one-sided thin film capacitive touch sensors with conductive ground plane layers to substantially mitigate the two-sided functionality of the thin film capacitive touch sensors described in the discussion above regarding FIGS. 1-6. For devices that may be handheld, such as games, toys, books, and greeting cards, one-sided thin film capacitive touch sensors may improve the ability with which a user may properly interact with such devices.

FIG. 7 illustrates a one-sided thin film capacitive touch sensor 60 with a conductive ground plane layer 62. The one-sided thin film capacitive touch sensor 60 comprises a capacitive touch sensor layer 64 separated from the conductive ground plane layer 62 with a separation layer 66. The capacitive touch sensor layer 64 is a two-sided thin film capacitive touch sensor as described in the discussion regarding FIGS. 1-4. In this embodiment, the separation layer 66 is a thin sheet of dielectric material like paper or plastic. The conductive ground plane layer 62 is constructed by mounting a very thin sheet of conductive material such as aluminum foil or screen printed conductive ink on the backside of the separation layer 66. The separation between the capacitive touch sensor layer 64 and the conductive ground plane layer 62 is a minimum of 0.5 mm. Any separation less than 0.5 mm causes base capacitance of the capacitive touch sensor layer 64 to increase dramatically, so much so that any touch by a human finger will not change the effective capacitance of the capacitive touch sensor layer 64, rendering such touches undetectable. Any separation less than 0.5 mm may also cause the one-sided thin film capacitive touch sensor 60 to experience large changes in base capacitance when the capacitive touch sensor layer 64 experiences mechanical bending. Simply flexing the one-sided thin film capacitive touch sensor 60 may lead to fluctuations in effective capacitance larger than those typically seen when one-sided thin film capacitive touch sensor 60 is touched by a human finger, degrading the touch sensitivity of the one-sided thin film capacitive touch sensor 60.

FIG. 8 illustrates a one-sided thin film capacitive touch sensor 70 with an alternative ground plane configuration. The one-sided thin film capacitive touch sensor 70 has one or more capacitive elements 71 (not visible this view, see FIG. 9) deposed on a thin film 78 to form a capacitive touch sensor layer 74 and a conductive ground plane layer 72 deposed on the same thin film 78, the thin film 78 wrapped around a separation layer 76. In this embodiment, the separation layer 76 is a thin sheet of dielectric material like paper or plastic.

FIG. 9 shows another view of the one-sided thin film capacitive touch sensor 70 of FIG. 8, showing the capacitive elements 71 and conductive ground plane layer 72 deposed on the same thin film 78, the thin film 78 laid flat, but configured to be wrapped around separation layer 76 (see FIG. 9 with arrow showing wrapping action). The conductive ground plane layer 72 may be a grid or solid fill pattern, as described above regarding FIGS. 1-4. In some embodiments, capacitive elements 71 and the conductive ground plane layer 72 may be formed from the same conductive material (e.g., conductive ink) and substantially simultaneously (e.g., from the same patterned printing screen). Also shown are electronics 80 for measuring the effective capacitance of the one-sided thin film capacitive touch sensor 70.

Figure 10:
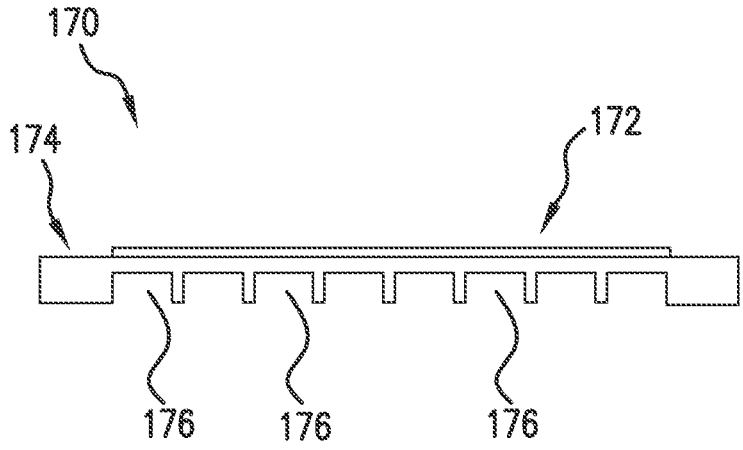
FIG. 10 illustrates a side view of a capacitive touch sensor with air gap layers for shielding.
Figure 11:
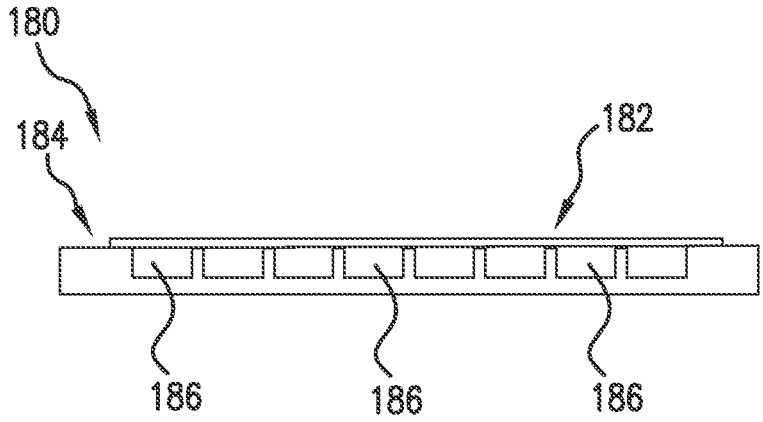
FIG. 11 illustrates a side view of a capacitive touch sensor of an alternate embodiment with air gap layers for shielding.

One-Sided Capacitive Touch Sensors with an Air Gap (FIGS. 10-11)

FIGS. 10-13 illustrate embodiments with an air gap layer to substantially mitigate the two-sided functionality of the thin film capacitive touch sensors described above in the discussion of FIGS. 1-6 while maintaining low cost and simple construction. For devices that may be handheld, such as games, toys, books, and greeting cards, the one-sided functionality of the thin film capacitive touch sensors may improve the ability with which a user may properly interact with the such devices.

As an alternate approach to using a conductive ground plane layer shield to form a substantially one-sided capacitive touch sensor, other embodiments use materials with very low dielectric constants as a shield for one side of the capacitive touch sensor. More specifically, one very inexpensive material with a very low dielectric constant is air. The inclusion of an air gap layer will lower the capacitive sensitivity on the air gap layer side of the capacitive touch sensor. Nevertheless, a capacitive field may still be triggered by proximity though the air depending on the configuration of the capacitive touch sensor. Accordingly, one-sided thin film capacitive touch sensors with an air gap layer should be tested for any potential application to determine their suitability. For example, there is a relationship between the size/area of a touch capacitive touch sensor and its proximity sensitivity through air. Generally, larger capacitive touch sensors are more sensitive and may require a thicker air-gap for proper shielding. As a guideline, the air gap layer should be at least the thickness of any overlay material on top of the capacitive elements. For example, a configuration that includes a thin film capacitive touch sensor 2 mil thick (thin film with capacitive elements printed in conductive ink on its underside), an printed art layer 10 mil thick and a 5 mil layer of glue totals an overlay of 17 mil over the capacitive elements. This would suggest an air gap layer of at least a 17 mil (~0.5 mm). For capacitive elements less than 2 square inches in area, an air gap layer of five times the overlay thickness have proven to be sufficient.

FIG. 10 shows a side view of an embodiment of a one-sided thin film capacitive touch sensor 170 with an air gap layer 176 for shielding. The one-sided thin film capacitive touch sensor 170 includes a capacitive touch sensor layer 172 mounted to a separating base 174. The separating base 174 has a molded or cut pattern to create the air gap layer 176 on a side of the separating base 174 opposite the capacitive touch sensor layer 172. The separating base 174 prevents foreign objects, such as a human finger, from entering the air gap layer 176 and changing the effective capacitance of a sensor in the capacitive touch sensor layer 172. The air gap layer 176 mitigates sensitivity to touch from the bottom, as explained above. In this embodiment the separating base 174 has a lattice structure, but in other embodiments, structures with other geometries, such as a corrugation structure, may be used to create the air gap layer 176.

FIG. 11 shows a side view of one-sided thin film capacitive touch sensor 180 including an air gap layer 186 for shielding. The one-sided thin film capacitive touch sensor 180 includes a capacitive touch sensor layer 182 mounted to a separating base 184. The separating base 184 has a molded or cut pattern to create the air gap layer 186 on a side of the separating base 184 closest to the capacitive touch sensor layer 182. The separating base 184 prevents foreign objects, such as a human finger, from entering the air gap layer 186 and changing the effective capacitance of a sensor in the capacitive touch sensor layer 182. The air gap layer 186 mitigates sensitivity to touch from the bottom. In this embodiment the separating base 184 has a lattice structure, but in other embodiments, structures with other geometries, such as a corrugation structure, may be used to create the air gap layer 186.

Figure 12:
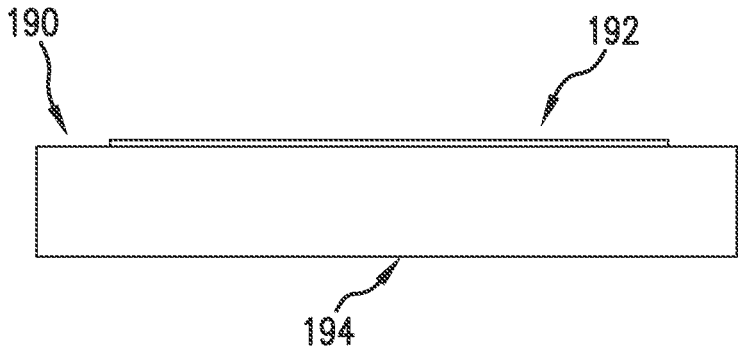
FIG. 12 illustrates a side view of a capacitive touch sensor of an alternate embodiment with separating material for shielding.
Figure 13:
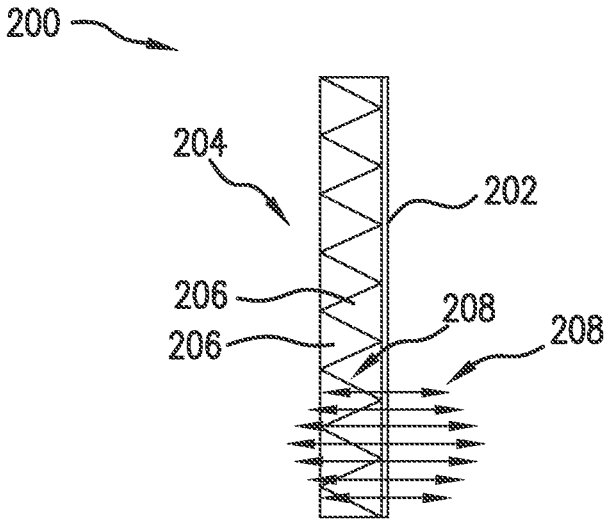
FIG. 13 illustrates a side view of a capacitive touch sensor mounted on corrugated cardboard for shielding.

One-Sided Capacitive Touch Sensors with a Separating Layer (FIGS. 12-13)

FIG. 12 shows a side view of a one-sided thin film capacitive touch sensor 190 including a thick separating material 194. The one-sided thin film capacitive touch sensor 190 includes a capacitive touch sensor layer 192 mounted to the thick separating material 194. The thick separating material 194 is a non-conducting material such as plastic or cardboard. The one-sided thin film capacitive touch sensor 190 reduces or eliminates sensitivity to touches on the back side of the capacitive touch sensor layer 192 with thick separating material 194. The thick separating material 194 forces such touches further from the back side of the capacitive touch sensor layer 192 and accordingly reduces change to effective capacitance of the capacitive touch sensor layer 192 during such touches.

FIG. 13 shows a one-sided thin film capacitive touch sensor 200 with air gap layer 206 provided by a corrugated structure 204, such as corrugated cardboard or similar materials. The thin film capacitive touch sensor 200 has a capacitive touch sensor layer 202 mounted on the corrugated structure 204, which mitigates sensitivity to touches on a side of the capacitive touch sensor layer 202 nearest the corrugated structure 204 (i.e. the back side) due to diminished strength of a capacitive field 208 generated by the capacitive touch sensor layer 202 after passing through the corrugated structure 204. Such corrugated structures, in particular with corrugated cardboard and the like, are inexpensive construction materials common to games and toys.

Further, the capacitive touch sensor layers described in the embodiments above need not be planar layers. For example, capacitive touch sensor layers (and any ground plane shield layer and/or air gap layer) may be formed in a non-planar configuration. Further, for a substantially enclosed non-planar configuration (e.g., a bottle, can, or other container), the interior of the container may serve as the air gap layer to substantially mitigate or prevent false and/or unintentional capacitive touch sensor triggering.

Guitars with Capacitive Touch Sensors (FIGS. 14-17)

Figure 14:
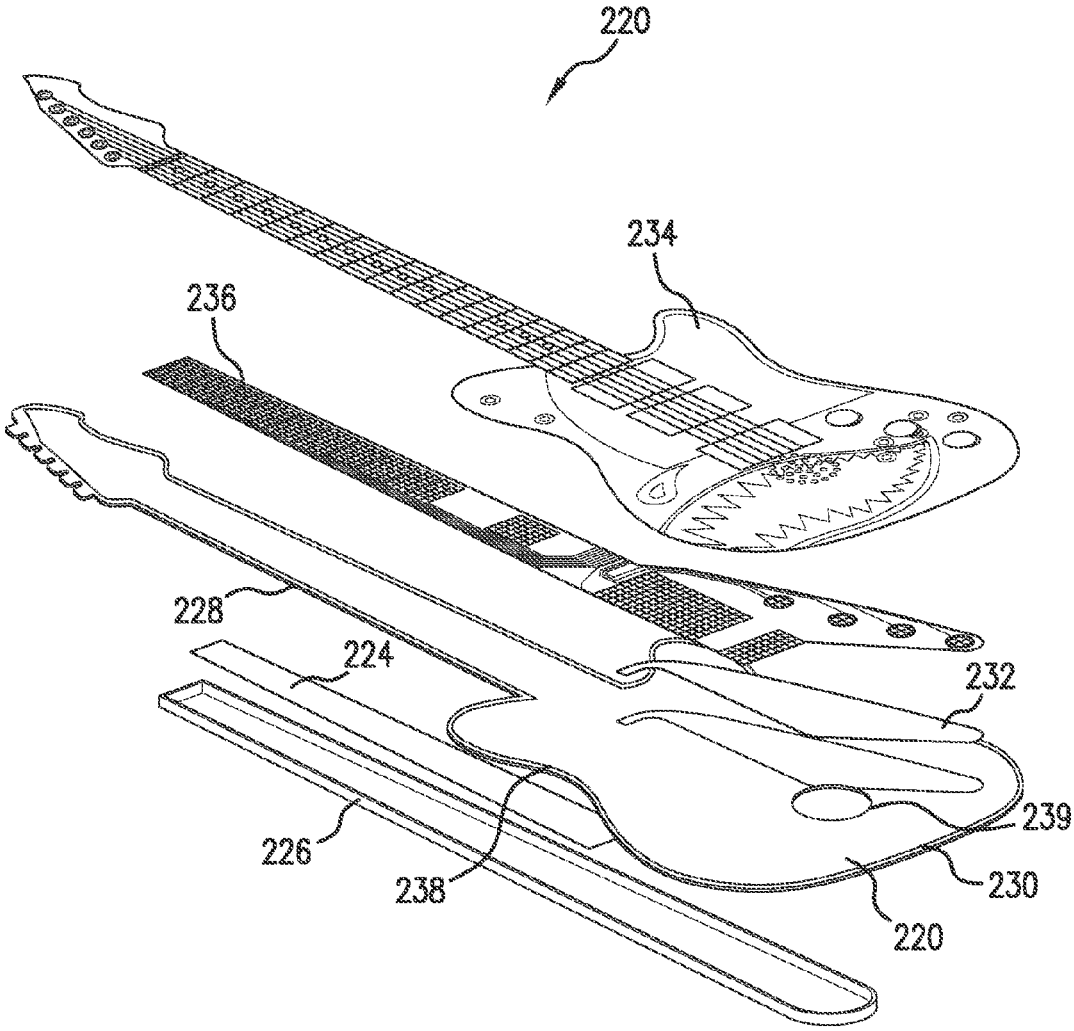
FIG. 14 illustrates guitar construction with thin film capacitive touch sensors and one or more conductive ground plane layers.

FIG. 14 illustrates a capacitive guitar 220 embodiment construction using a separate printed sensor layer beneath the printed art layer. The capacitive guitar 220 comprises a guitar body 222, a guitar neck 228, a neck housing 226, a neck conductive ground plane layer 224, a body conductive ground plane layer 230, a body separation layer 232, a printed art layer 234, capacitive touch sensor layer 236, an electronics package 238 and a speaker 239. In this embodiment, two separate conductive ground plane layers are used because of the product's physical design. The guitar body 222 provides a separation layer for a neck conductive ground plane layer 224. This is possible because of the neck housing 226 covering the back of the guitar neck 228. The body conductive ground plane layer 230 doesn't have a separate housing covering the back of the entire guitar body 222, so it is mounted on the top of the guitar body 222 with body separation layer 232 between it and the capacitive touch sensor layer 236.

Figure 15:
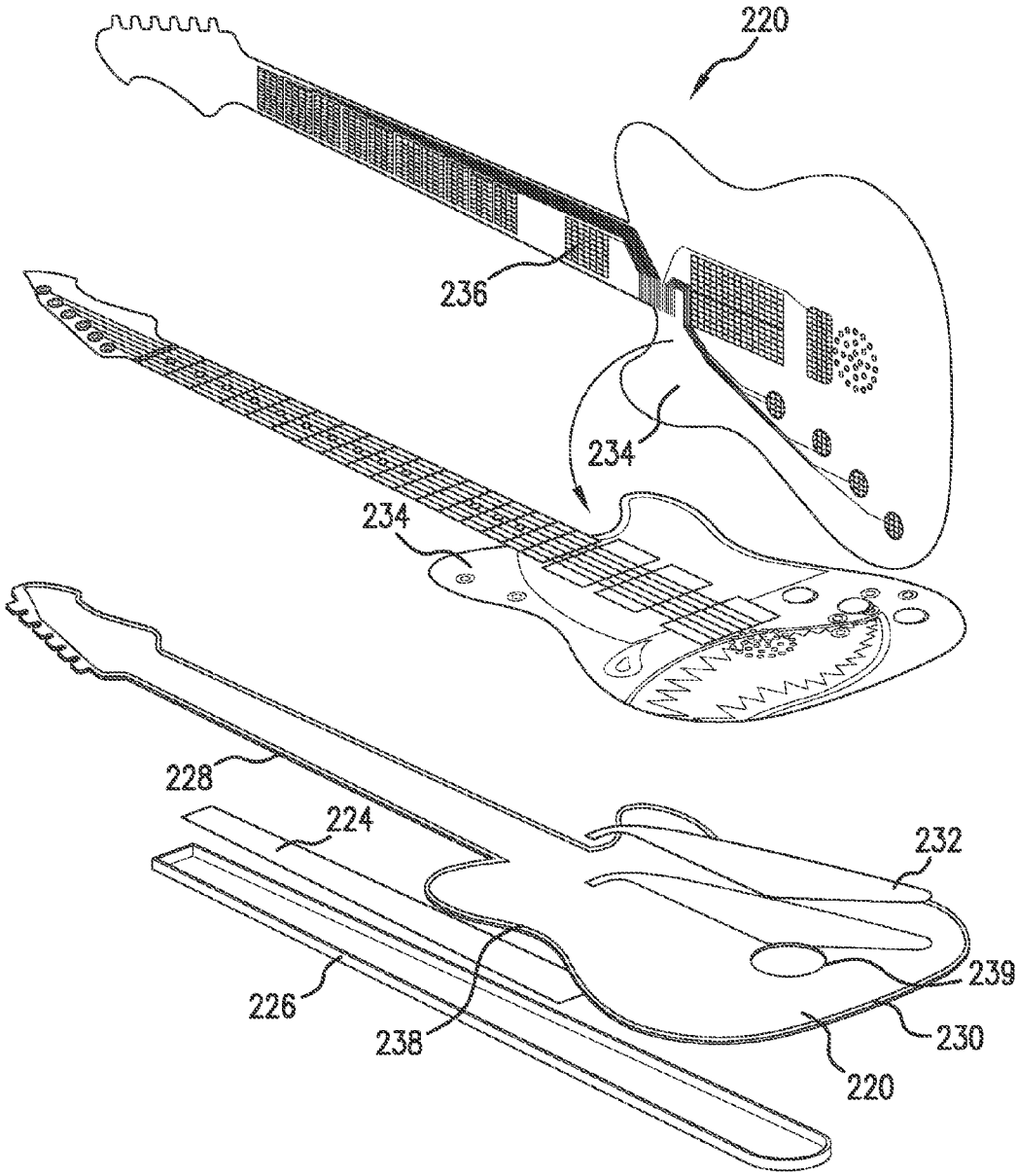
FIG. 15 illustrates guitar construction of an alternate embodiment.

Alternately, as illustrated by FIG. 15, the capacitive touch sensor layer 236 combined into the printed art layer 234, the combined layer with both full color printing on the front side and screen printed capacitive elements on the backside or underside.

Figure 16:
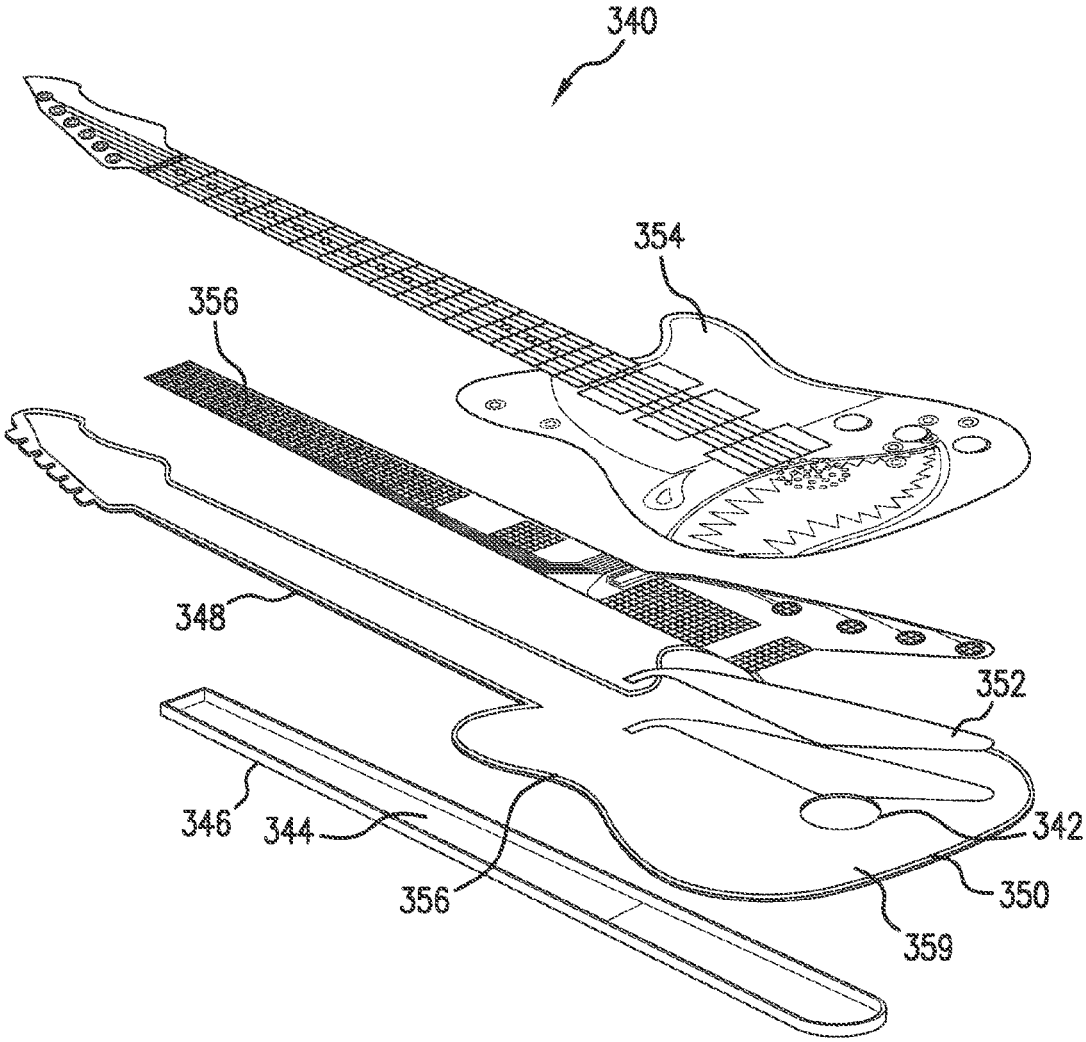
FIG. 16 illustrates a guitar construction method with thin film capacitive touch sensors and an air gap layer.

FIG. 16 illustrates a capacitive guitar 340 embodiment utilizing capacitive touch sensors shielded an air gap layer 344 and other capacitive touch sensors shielded by a conductive ground plane layer 350. The capacitive guitar 340 also comprises a guitar body 342, a guitar neck 348, a neck housing 346, a separation layer 352, a printed art layer 354, capacitive touch sensor layer 356, an electronics package 358 and a speaker 359. In this embodiment, both the conductive ground plane layer 350 and the air gap layer 344 are used because of the product's physical design. This neck housing 346 creates the air gap layer 344 for structural support as well as capacitive shielding. There is no similar housing covering the back of the entire guitar body 342 and creating an air gap, so to provide shielding, the conductive ground plane layer 350 is mounted on the top of the guitar body 342 with the separation layer 352 between it and the capacitive touch sensor layer 356.

Figure 17:
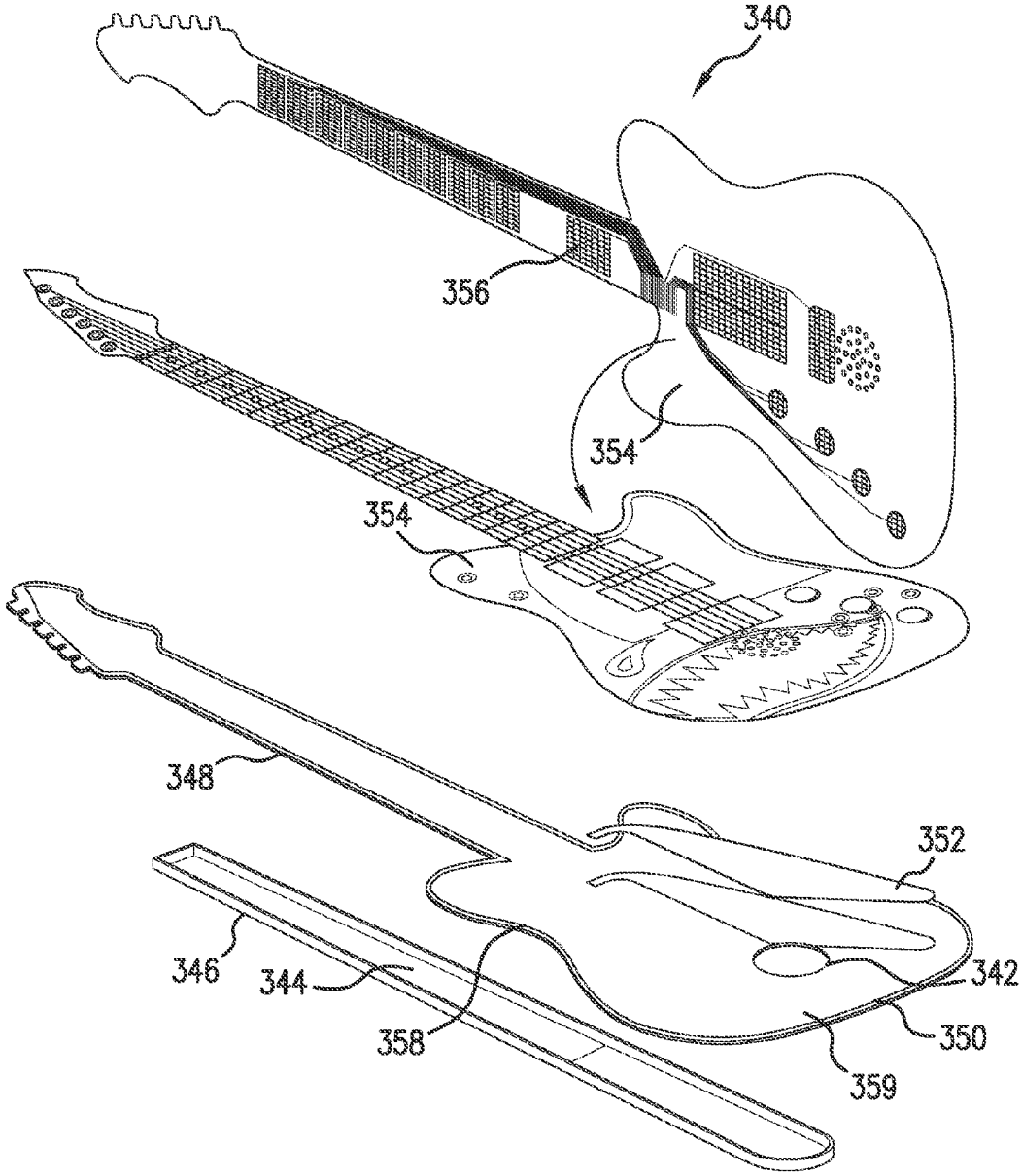
FIG. 17 illustrates a guitar construction method of an alternate embodiment.

The air gap layer 344 provided in and/or formed by the neck housing 346 and the conductive ground plane layer 350 provided in the guitar body 342 behind the respective parts of the capacitive touch sensor layer 356 mitigate the capacitive touch sensor sensitivity to false and/or unintentional capacitive touch sensor triggering. In the embodiment shown in FIG. 16, the printed art layer 354 and the capacitive touch sensor layer 356 are separate. In an alternate embodiment, as illustrated by FIG. 17 the capacitive touch sensor layer 356 is combined with the printed art layer 354, with thin film capacitive touch sensors screen printed or otherwise formed on the underside or backside of the printed art layer 354.

Guitar Sensor Layout and Function (FIGS. 18-24)

The layout of individual capacitive touch sensors and functions associated with each determines the interactivity a user may have with a guitar. FIGS. 18-24 illustrate an embodiment of a guitar with a specific layout of capacitive touch sensors. The capacitive touch sensors may be constructed as described with reference to FIGS. 1-13. Functions described in FIGS. 18-24 are performed by the capacitive touch sensors described herein together with a guitar electronics package (microprocessors, memory, etc.) and speaker that are not described in detail, but whose structure and general function will be known to those skilled in the art (See FIGS. 14-17 for an example of the physical location of electronic package and speaker within the guitar of that embodiment).

Figure 18A:
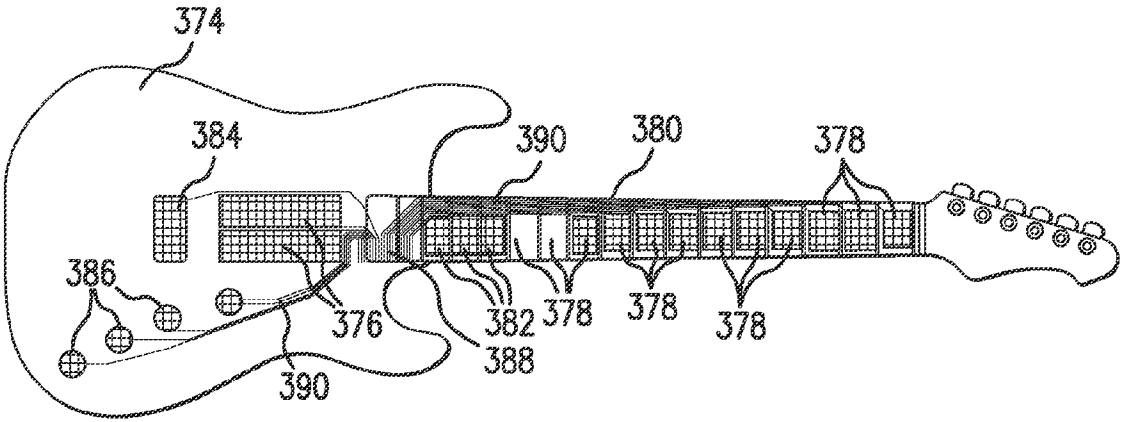
FIGS. 18A and 18B illustrate a capacitive touch sensor layout of a guitar embodiment.
Figure 18B:
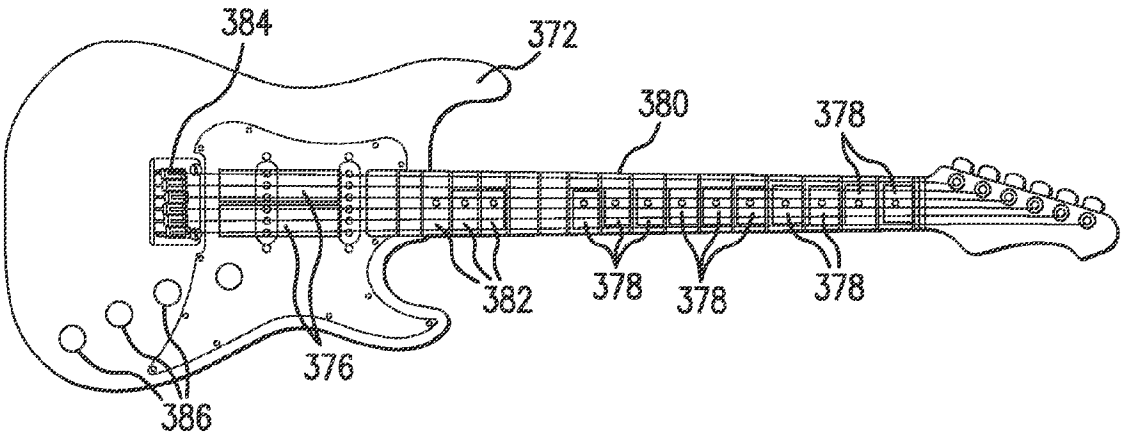

FIGS. 18A and 18B illustrate a capacitive touch sensor layout of the guitar embodiment. FIG. 18A shows view of a capacitive touch sensor layer 374. FIG. 18B shows a view of the capacitive touch layer 374 of FIG. 18A combined with, and mated under, a printed art layer 372. In FIG. 18B, location and shapes of capacitive touch sensors are shown to aid understanding, though typically they would not be visible looking at the printed art layer 372 from above. FIGS. 18A and 18B more specifically illustrates that the combination of the printed art layer 372 and underlying capacitive touch sensor layer 374 produces touch sensitive/responsive portions or areas of the guitar, or "touch spots" to emulate one or more functional areas of a real guitar. In this embodiment, one or more capacitive touch sensors may be screen printed on to a thin polyester sheet with conductive ink to form the capacitive touch sensor layer 374. The printed art layer 372 is formed separately, then mated over the capacitive touch sensor layer 374, with areas of the printed art layer 372 positioned over corresponding areas of the capacitive touch sensor layer 274. However, in other embodiments, the capacitive touch sensors may be integrated in the printed art layer 372.

FIGS. 18A and 18B further illustrate one or more strum sensors 376 included in the guitar 370. The strum sensors 376 are positioned within the capacitive touch layer 374 such that they are located approximately where pickups would be on a standard electric guitar. The printed art layer 372 may have pickups depicted in the area over the strum sensor 376. One function of the strum sensors 376 is to detect the user's hand motions when playing the guitar. For example, moving a hand (while touching the guitar surface) up, down, or simply tapping will create capacitive events that can be detected by the strum sensors 376 and interpreted by the electronics package (not shown). The strum sensors 376 will be described in more detail below with respect to FIGS. 19, 20, and 21.

FIGS. 18A and 18B further illustrate one or more fret sensors 378 included in the guitar. The fret sensors 378 are located on the guitar neck 380 (e.g., finger or fret board) between images of frets on the printed art layer 372. The one or more fret sensors 378 are configured to detect single or multi-fret touches. For example, one or more fret sensors 378 may be triggered substantially simultaneously to play one or more notes and/or chords. The fret sensors 378 in one embodiment may also be used as a menu to facilitate a modal interface for selecting between and/or among various guitar functions. The chord configuration and modal interface will be described in more detail below with respect to FIGS. 20-24.

FIGS. 18A and 18B further illustrate a high neck sensor 882 included in the capacitive touch sensor layer 374. The high neck sensor 382 is located within the capacitive touch sensor layer 374 in the guitar neck on the fret board just above the neck joint. The high neck sensor 382 can be used for many different features depending on the guitar's mode. One example is to use it as an easier way to play muted strums. The electronics of the guitar are programmed such that touching t the high neck sensor 382 at any point (when in certain guitar modes) will cause the strum/chord sounds to play as muted strums.

FIGS. 18A and 18B further illustrate a palm mute sensor 384 located within the capacitive touch sensor layer 374 approximately where the bridge of a real guitar would be located. While playing the guitar in certain modes, placing the palm or other portion of a hand on the palm mute sensor 384 may quiet or silence the guitar. Additionally, strumming the guitar with a palm on the palm mute sensor 384 may create muted strums. The palm mute sensor 384 will be described in more detail.

FIGS. 18A and 18B further illustrate one or more control sensors 386 included in the guitar. For example, one or more control sensors 386 may correspond to and be located underneath one or more control knob graphics on the printed art layer 372 of the guitar. In one embodiment, the one or more control sensors 386 may require substantially continuously touching for a period of time (in one embodiment approximately 0.5 seconds or more) before they are activated. The substantially continuous touching may prevent the control sensors 386 from accidentally triggering during strumming given their location relative to the strum sensors 376. The one or more control sensors 386 will be described in more detail below.

FIGS. 18A and 18B finally illustrate a printed circuit board (PCB) bus connection 388 included in the guitar. In one embodiment, each of the capacitive touch sensors (e.g., the one or more strum sensors 376, fret sensors 378, high neck sensor 382, palm mute sensor 384, and control sensors 386) may electrically couple to PCB bus connection 388 with thin conductive traces 390. The conductive traces 390 may be printed with conductive ink, for example as the capacitive touch sensors themselves are printed. More specifically, the PCB bus connection 388 may be printed on the same surface and/or layer as the one or more capacitive touch sensors. Alternately or additionally, at least a portion of the PCB bus connection 388 may be printed on a separate surface and/or layer from at least one of the capacitive touch sensors. The PCB bus connection 388 area may also electrically couple to, for example, an electronics package and/or PCB (not illustrated) that may contain a microprocessor, memory, and/or any other electronic devices to detect and process input signals from one or more capacitive touch sensors. The PCB bus connection 388 may couple to the electronics package with, for example, a flexible connection (e.g., flex circuit) or any other connection known in the art to electrically couple circuits and/or PCBs together.

Figure 19:
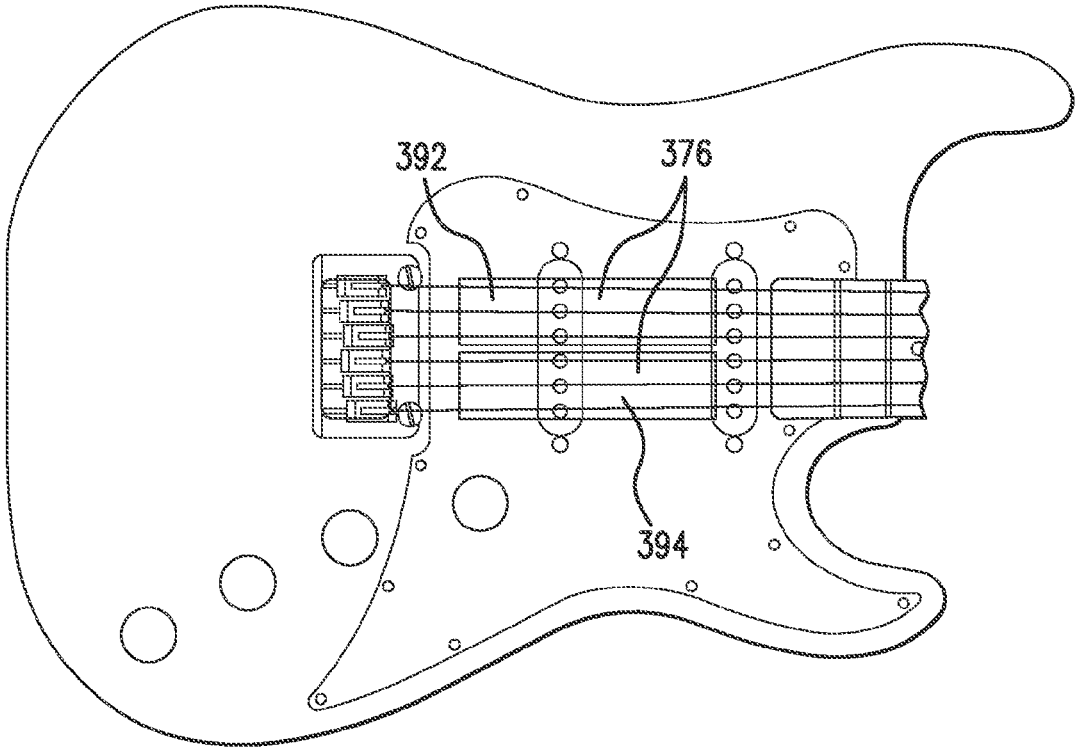
FIG. 19 illustrates the strum sensor of the guitar.

FIG. 19 illustrates the one or more strum sensors 376 in more detail. The design and functionality of the strum sensors 376 may balance performance and the amount of audio data available for the available electronics at the target price/cost. In one embodiment, two strum sensors 376 are located adjacent and underneath the printed art showing the guitar strings and one or more pickups. The two strum sensors 376 are positioned such each strum sensor may correspond to a set of printed art strings. Accordingly, the two strum sensor design may detect the direction of a strum, for example based on which of the two strum sensors 376 (e.g., an upper strum sensor 392 and a lower strum sensor 394) is triggered first. As real guitar strums sound different when strummed up instead of down because the strings are hit in a different order (low-to-high or high-to-low), so too may the guitar.

Figure 20:
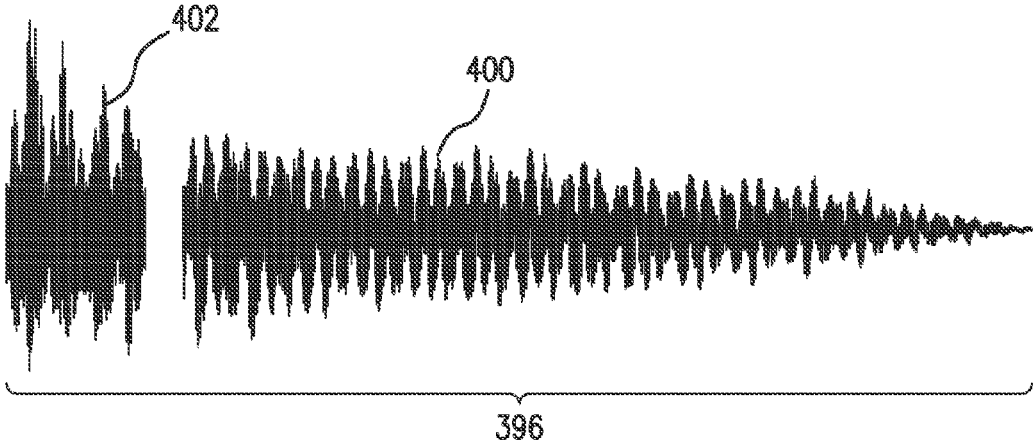
FIG. 20 illustrates the up strum attack sample and chord sample of the guitar.
Figure 21:
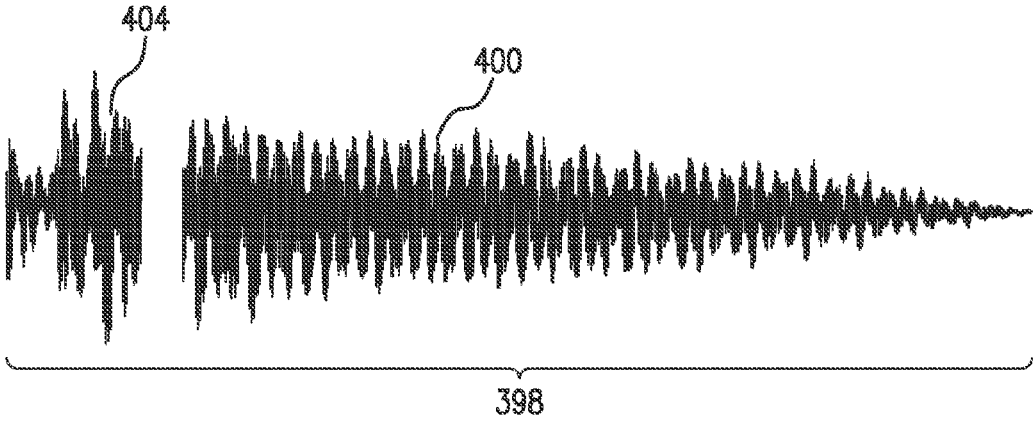
FIG. 21 illustrates the down strum attack sample and chord sample of the guitar.

More specifically, FIG. 20 illustrates an up strum signal trace 396 and FIG. 21 illustrates a down strum signal trace 398. The direction of the strum may be determined at least in part by which strum sensor (e.g., the upper strum sensor 392 or the lower strum sensor 394) is triggered first. More specifically, the guitar may generate at least a partially alternate audio playback signal depending on the direction of the strum. In one embodiment, the guitar may output separate audio samples for guitar chords played with up and down strums. In an alternate embodiment, the guitar may output common audio samples for guitar chords regardless of up and down strums, but may include different attack samples for an up strum versus a down strum to approximate the starting sound for up and down strums. FIGS. 20 and 21 further illustrate the output of a common chord sample 400 preceded by alternate attack samples for up and down strums (up strum attack sample 402 and down strum attack sample 404). Compared to storing and outputting separate audio samples for an up strum versus a down strum, combining the common chord sample 400 with a preceding up strum or down strum attack sample may reduce the amount of memory and/or processing complexity required by the guitar while still providing substantially distinct up strum and down strum sounds.

To implement the alternate up strum and down strum audio output, the two strum sensors 376 may detect both the direction and the speed of the strum. In a simple case, a complete strum may include touching/triggering both strum sensors 376 so that the direction and speed may be detected. Alternately, touching/triggering one of either the upper strum sensor 392 or lower strum sensor 394 may trigger playing the appropriate attack sound (e.g., from the up strum attack sample 402 or the down strum attack sample 404). When the other strum sensor is touched/triggered, the attack sound may be interrupted to start playing the chord body. Accordingly, the delay between triggering the first and second strum sensor may cause the strum sound to vary with how quickly the user strums. If the second strum sensor is not touched/triggered or if the end of the attack sound is reached before the second strum sensor is touched/triggered, the chord body may play after the end of the attack sound. After the first strum sensor is released, and if the second strum sensor is not touched/triggered, strum logic may reset after a timeout period so that interference with the playback of the chord body sample (e.g., by subsequent triggering of a strum sensor) may be mitigated. If the first strum sensor is touched/triggered again before the second strum sensor is released, as when the user makes quick, short strums that move rapidly between the two strum sensors 376, the guitar may repeat the chord body without replaying the attack sound.

In an alternate embodiment utilizing only one strum sensor, an up strum may not be differentiated from a down strum. Nevertheless, a separate attack sound sample may be employed along with the chord body sample. For example, if only one strum sensor were used, the guitar may start playing an attack sound when the strum sensor is touched. When the strum sensor is released, the guitar may interrupt the attack sound and start playing the chord body. The guitar may play the chord body after the attack sound if the strum sensor has not been released.

In addition to detecting up strums and down strums, the strum sensors 376 may respond to and/or function in one of three modes. The three modes include a Freestyle Mode, a Rhythm mode, and a Perfect Play mode. Two of these modes (e.g., Freestyle and Rhythm) may cause the actual playback of sampled and/or pre-recorded audio for guitar chords. The other mode (Perfect Play) may enable the playback of the guitar audio track with pre-recorded music. Accordingly, the guitar may produce a different audio output depending on both the guitar mode and the specific triggering of the one or more strum sensors 376.

For example, in Rhythm mode, the guitar may play pre-recorded background music and vocal tracks for a song while the user plays chords or other guitar effects by strumming. The particular sound that the guitar plays when the user strums is controlled by an audio engine in the electronics package. The audio engine may use a data table to select audio samples that are synchronized with the song. The combination of user triggering one or more strum sensors 376 and audio engine selection gives the user the ability to play any strum pattern while always playing the right note for the pre-recorded background music.

More specifically, part of each pre-recorded song's data is a chronological list of audio samples and associated time markers. The timing information is formatted identically to the Perfect Play strum markers (as will be described in more detail below). As the audio engine plays back a song in Rhythm mode, it sets the active audio sample or samples when song playback reaches each time marker in the data table. When the user strums, the currently active audio sample is played. In one embodiment, the audio samples are all chords, and Rhythm mode can be thought of as tracking chord changes and allowing the user to strum chords along with the song. Rhythm mode accordingly allows a user some flexibility to alter the timing of the chord playback while ensuring that the proper chord is played to correspond to the pre-recorded audio or song samples.

Figure 24:
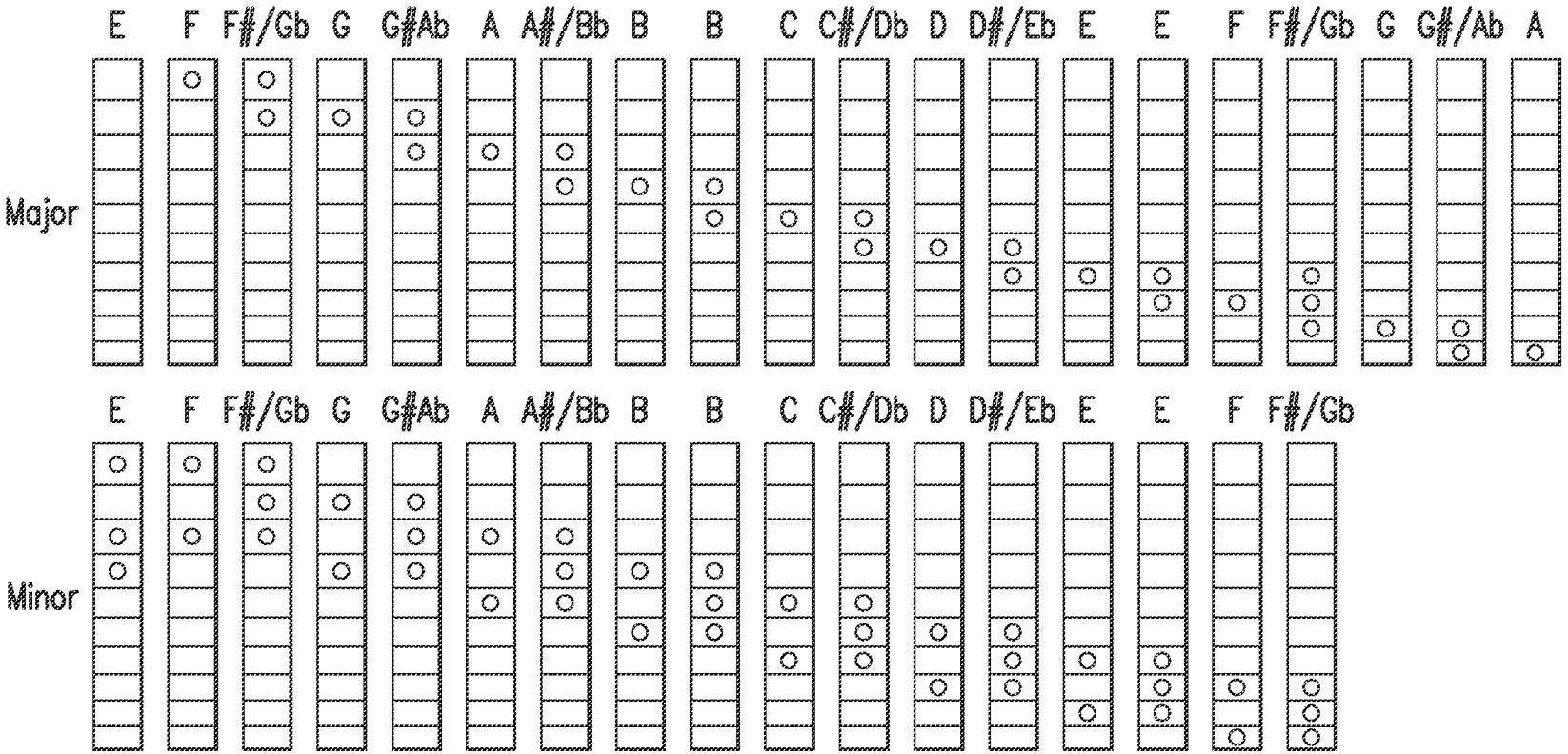
FIG. 24 illustrates the chord fingering chart of the guitar.

Alternately, in Freestyle mode, the guitar operates as a solo instrument with no background music offering the user flexibility in both chord timing and chord selection. For example, the guitar may include a complete set of major and minor chords samples that can be played by touching a fret or fret combination strumming. FIG. 24 includes a fingering pattern for the guitar that allows all chords to be selected using only ten fret sensors 378. FIG. 24 will be discussed in more detail below. Freestyle mode is the most difficult operating mode of the guitar as it requires the most user interaction to select rhythm and sound playback. As such, however, it also allows the user the most freedom and creativity to play whatever they choose.

Perfect Play mode is the third of the three main operational modes for the guitar of an embodiment, and is the easiest mode for the user. In this mode, the guitar plays a song's background music and vocal tracks, and the user's actions control playback of the song's main instrumental track. For example, strumming the guitar enables playback of the main instrument track. Playback of the main instrument track may stop after a short time if the user stops strumming. Perfect Play mode may include alternate or additional features such as the use of selectable, alternate main instrument tracks, the ability to control volume of main instrument track by speed of playing or physical orientation of the instrument, the introduction of additional user-triggered effects in addition to main instrument track.

To implement Perfect Play mode, the audio playback engine may enable the use of "strum markers." For example, each song's data may include a chronological list of strum markers that indicate times at which playback of the main track should be muted if the user has stopped strumming. The table of strum points is compiled manually based on the song's main instrument track and reflects points at which a musician would actually play while in the song. This allows the guitar to have predefined musical phrases for the music's guitar part and may prevent the guitar track from muting in the middle of such phrases.

In one embodiment, the audio engine may utilize strum makers with time units of audio samples, so the strum markers may be compiled with knowledge of the final sampling rate. Alternate embodiments could use different units such as seconds (or milliseconds) or measures and beats. The data may be stored as time delays relative to the previous strum marker, or may be stored according to an absolute time format.

When audio or song playback reaches a strum point identified at least in part by a strum marker, the guitar's firmware may mute the guitar track if the user has not strummed for a certain period of time. For example, the time period may be 0.5 second for the guitar of an embodiment, but may be easily changed to reflect a particular song recording. The delay could further be different for each song. If the user has strummed within the required period or delay, the guitar track will continue playing at least until the next strum marker is reached. If the user strums while the main song track is muted, it will be immediately un-muted without waiting until a strum marker is reached. Each time the user strums, the time is stored or a timer is reset so that the time since the last play event can be checked when a strum marker is reached. Playback of the main track may continue internally while the guitar is muted so that it remains synchronized with playback of the song's other tracks.

For both Rhythm and Perfect Play modes, the user starts playback of a song by, for example, triggering one or more touch sensors or other controls already present in the instrument. In some embodiments, the user may start song playback by strumming the guitar (i.e., triggering one o both of the strum sensors 376). In some embodiments, the strumming may first initiate a count-in. The count-in informs the user of the song's tempo and gives him or her time to prepare. The count-in for a song may typically be two measures, but can vary from song-to-song as appropriate. Further, as the guitar may be joined by one or more other instruments similarly designed that include one or more of the same songs, the count-ins for a particular song for multiple instruments are the same length, and starting a song on any instrument may use only a single action such as touching a strum sensor.

Figure 22:
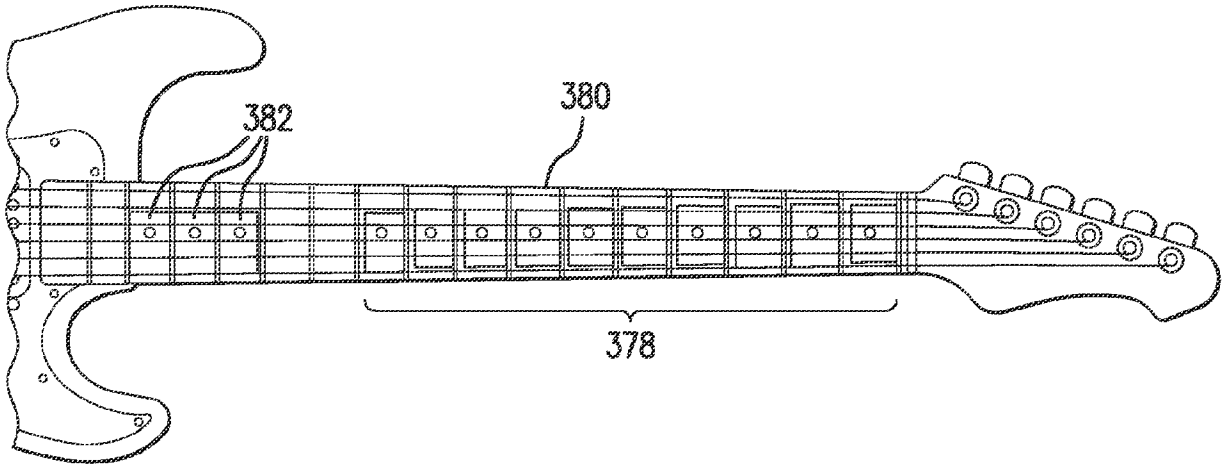
FIG. 22 illustrates the neck and fret sensors of the guitar.
Figure 23:
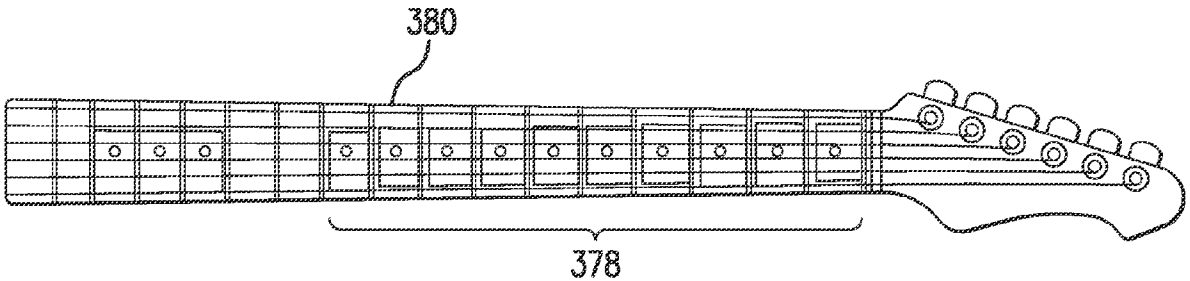
FIG. 23 illustrates the fret sensors of the guitar.

FIGS. 22 and 23 show more detailed views of the guitar neck sensors including the high neck sensor 382 and the one or more fret sensors 378. In this embodiment, there is one high neck sensor 382 and ten fret sensors 378. In other embodiments, there may be different numbers of high neck sensors and fret sensors. The fret sensors 378 are located on the guitar neck 380 (fret board) between the printed art frets. The fret sensors 378 may be configured to detect single or multi-fret touches to play chords and/or to select one or more guitar operating modes. For example, touching/triggering one or more fret sensors 378 may select the operating mode of the guitar, select the volume of the audio output, select and/or control the music track (e.g., selecting the playback song), and control which guitar chords are played during Freestyle mode.

To select a guitar operating mode, the guitar may include a mode touch sensor. The mode touch sensor may be, for example, one of the control sensors 386 on the body of the guitar as illustrated by FIGS. 18A and 18B. The user may first touch/trigger the mode sensor to enable menu selection, and then may touch one of the fret sensors 378 to select a different operating mode. The guitar may require the user to hold the mode touch sensor for a period (about 0.5 seconds) before mode selection is enabled. This may prevent unintentional touches of the mode touch sensor from causing the guitar to unintentionally enter mode selection. Alternately, the guitar could require the mode touch sensor to be held down while simultaneously selecting a mode or the requirement could be removed altogether. In one embodiment, the operating mode assigned to each fret may be printed on the side of the guitar neck 380. Alternately, the mode may be printed on the fret artwork or molded into the guitar neck plastic. In addition to selecting a particular mode (e.g., Rhythm, Freestyle, or Perfect Play), the user may also select a different pre-recorded audio track or song (e.g., as indicated by Rhythm 1, Rhythm 2, and Rhythm 3).

One or more fret sensors 378 may also control the volume of the audio output of the guitar. To select a volume level, the user may touch and hold a volume control touch sensor while simultaneously touching a fret with his left hand. The volume control touch sensor may be, for example, one of the control sensors 386 on the body of the guitar as illustrated by FIGS. 18A and 18B. More specifically, while triggering/holding the volume control sensor, the user can slide a finger up and down the frets (e.g., triggering one or multiple fret sensors 378) to adjust volume. The number of frets and the specific volume levels assigned to them can vary. The direction of volume increase can be reversed so that frets near the guitar nut (farthest away from the guitar body) correspond to higher rather than lower volumes. Finally the guitar may require the user to hold the volume control sensor while adjusting the volume or it can be configured to enable volume adjustment when touched and return to normal operation on a second touch. Further, in order to prevent accidental volume adjustment, the guitar may require the user touch and hold the volume adjustment control sensor for a period (e.g. 1 second) before volume adjustment is enabled.

As illustrated, the guitar accordingly only requires one additional touch sensor to implement volume control. In other implementations a minimum of two touch sensors (for volume up and volume down) or a hardware volume control knob would be required. A system with one touch sensor that allows the user to rotate through volume control settings could also be implemented, but this system may be tedious and slow to use, or it may support only a small number of volume levels. Further, adjusting volume control in this manner is also intuitive and fun. It makes sense to increase volume by sliding a finger to a higher fret and to decrease it by sliding a finger lower. It is also fast in that a specific volume level can be immediately selected by touching a particular fret.

An additional use of the fret sensors 378 may be to select audio tracks to be muted or played for the selected audio sample or song. Muting selected audio tracks may correspond to a Karaoke Mode. For example, in the guitar of an embodiment, each non-guitar track may be assigned a particular fret. If Karaoke Mode is enabled, the user may select the tracks that should be muted by touching the frets assigned to those tracks when starting the song. Karaoke mode is described in more detail below. For the guitar of an embodiment, Karaoke mode is enabled by touching menu and demo sensors together while selecting an operating mode with a fret sensor, but other control arrangements are easily possible.

In addition to selecting modes, volumes, and the like, the fret sensors 378 may function to control the audio output of the guitar. For example, in Freestyle mode, the guitar may operate as a solo instrument with no background music. In one embodiment, the guitar may play a complete set of major and minor chords by touching a fret sensor and/or combinations of fret sensors 378 and strumming. FIG. 24 illustrates a fret fingering chart that includes a complete set of major and minor chords. In an alternate embodiment, the selection of chord forms may be expanded to include, for example, 7th chords or diminished chords. In a further embodiment, the Freestyle mode operation may include accompanying audio sample or songs so that the user may play along with strumming and/or chord freedom (as compared to Rhythm and Perfect Play modes).

The arrangement of the fret sensors 378 and their fairly large number makes them well suited to control applications beyond their use as frets. In one embodiment, the set of fret sensors 378 can be thought of as a general purpose adjuster or selector; they can be used either to select individual options from a set, or can be considered the analog of a linear adjustment or level control. By including additional touch sensors to change the function of the fret sensors 378, they can be used for many other tasks. For example, either alone or in combination with one or more other touch sensors, the fret sensors 378 may adjust the volume level of individual instrument tracks for an audio sample or song, adjust the operation or level of effects such as distortion or reverb, select among different guitar tracks or sets of guitar samples, and/or control playback pitch or tempo. The embodiments are not limited in this context.

The high neck sensor 382 may trigger a variety of guitar functions or operations either alone or in combination with other touch sensors. For example, triggering the high neck sensor 382 may initiate playing pre-designed guitar licks and patterns during music performance. More specifically, during a song performance in Perfect Play or Rhythm modes, touching/triggering the high neck sensor 382 may cause the guitar to play a short pre-recorded guitar solo that matches the current chord and style of the song. Touching/triggering the high neck sensor 382 may also mute a chord playback during Rhythm or Freestyle modes. For example, one technique to mute a real guitar is to lightly touch the guitar strings on the neck after or during strumming. Doing this during a strum creates a muted chord sound (much like a regular chord but softer and shorter). Doing this after a strum will cause the current guitar chord to quickly mute and shorten.

While playing the guitar in Freestyle and Rhythm modes, placing the palm of a hand on the palm mute sensor 384 may silence the guitar. Additionally, strumming the guitar with a palm on the palm mute sensor 384 may create muted strums. For muted strums the normal guitar chord samples may be played, but with a lower volume and a faster decay. Additionally, during operation when the palm mute sensor 384 is touched/triggered, the guitar chord sample played from strumming may be stopped and a short percussive sample played to mimic the sound of muting the strings at the bridge.

Though many modes and features have been described with reference to one or more sensors of the guitar of an embodiment, additional features may be implemented. For example, Rhythm mode can be expanded to offer additional features such as by adding audio samples specific to each song instead of the more generic chords currently used. Rhythm mode may further track changes in not just single audio samples but also in sets of audio samples. For example, each time marker in the Rhythm mode data table can be associated with samples for up strum, down strum, different fret fingers, and use of tremolo or mode sensors. All of these samples would be appropriate to the current section of the song being played and could expand creative expression while still keeping the user from playing a wrong note. Freestyle mode may similarly include additional features like the ability to play individual notes instead of chords, alternative fingerings to enable guitar licks or other sound effects, the use or tremolo, and the use of the tap sensor to allow access to alternative sounds.

For any of the operating modes, one or more audio tracks may be combined (e.g., proportionally mixed) to simulate audio effects such as guitar distortion, reverb, or other guitar audio effects. Rather than applying the affect by using digital signal processing, alternate audio tracks for the instrument with the affect already applied may be included. Further, the guitar may include an interface to adjust the intensity of the affect. For example, the fret touch sensors may operate as a linear adjustor to control the mix of multiple audio tracks, thereby adjusting the effect or effects.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

We claim:

1. A touch sensitive musical instrument comprising:

a capacitive touch sensor layer comprising conductive ink printed on a thin film substrate, further comprising a capacitive element with a conductive ink grid having less than complete conductive ink coverage, wherein a user touching or coming close to the capacitive touch sensor layer changes the capacitive element's effective capacitance by combining the person's capacitance with the capacitance of the capacitive element;

a separation layer adjacent the capacitive touch sensor layer; and a conductive ground plane layer adjacent the separation layer configured to shield a backside of the capacitive touch sensor layer.

2. The touch sensitive musical instrument of claim 1, the separation layer further comprising a dielectric material at least approximately 0.5 mm thick.

3. The touch sensitive musical instrument of claim 1, the conductive ink grid further having 50% or greater coverage.

4. The touch sensitive musical instrument of claim 1, the conductive ink grid further having 35% or greater coverage.

5. The touch sensitive musical instrument of claim 1 further comprising a printed art layer adjacent the capacitive touch sensor layer and opposite the separation layer.

6. The touch sensitive musical instrument of claim 5 wherein the capacitive touch sensor layer is integrally formed in the printed art layer.

7. The touch sensitive musical instrument of claim 6, the printed art layer further comprising an opaque layer disposed between printed artwork and the capacitive touch sensor layer.

8. The touch sensitive musical instrument of claim 1, the capacitive touch sensor layer further comprising a substantially one-sided capacitive touch sensor layer shielded by the conductive ground plane layer.

9. The touch sensitive musical instrument of claim 8, the one-sided capacitive touch sensor layer configured to substantially prevent sensing a touch on the backside of the touch sensitive musical instrument.

10. The touch sensitive musical instrument of claim 1, the conductive ground plane layer further comprising a metal foil.

* * * * *